US008201303B2

(12) United States Patent
Niederman et al.

(10) Patent No.: US 8,201,303 B2
(45) Date of Patent: Jun. 19, 2012

(54) VACUUM CLEANER LINT BRUSH ATTACHMENT

(75) Inventors: Robert R. Niederman, Downs, IL (US); Thomas Josefsson, Bloomington, IL (US); John C. Morphey, Normal, IL (US); Brian Wang Sun, Bloomington, IL (US)

(73) Assignee: Electrolux Home Care Products, Inc., Charlotte, NC (US)

( * ) Notice: Subject to any disclaimer, the term of this patent is extended or adjusted under 35 U.S.C. 154(b) by 155 days.

(21) Appl. No.: 12/722,921

(22) Filed: Mar. 12, 2010

(65) Prior Publication Data

US 2011/0209304 A1 Sep. 1, 2011

Related U.S. Application Data

(63) Continuation-in-part of application No. 29/356,614, filed on Mar. 1, 2010, now Pat. No. Des. 654,235.

(51) Int. Cl.
*A47L 5/36* (2006.01)

(52) U.S. Cl. ..... 15/398; 15/399; 15/246.2

(58) Field of Classification Search ..... 15/246.2, 15/310, 393, 394, 398, 399; *A47L 5/36, 9/00*
See application file for complete search history.

(56) References Cited

U.S. PATENT DOCUMENTS

| | | | | |
|---|---|---|---|---|
| 1,785,873 | A * | 12/1930 | Muller | 15/246 |
| 3,217,349 | A * | 11/1965 | Hull et al. | 15/311 |
| 3,421,171 | A | 1/1969 | Tsuruzawa | |
| 4,956,892 | A | 9/1990 | Fawkes | |
| 5,148,571 | A | 9/1992 | Brazis et al. | |
| 7,107,643 | B1 | 9/2006 | McKay | |

OTHER PUBLICATIONS

International Search Report mailed Jun. 15, 2011, PCT/US11/26663 (2 pages).

* cited by examiner

*Primary Examiner* — David Redding
(74) *Attorney, Agent, or Firm* — Hunton & Williams

(57) ABSTRACT

A vacuum cleaner lint brush accessory system having a lint brush and cradle. The lint brush has longitudinally opposed handle and brush portions. The brush portion has a brush material adapted to remove fibrous substances from a surface to be cleaned. The cradle has a chamber opening leading to a chamber. The chamber extends in the longitudinal direction and is adapted to longitudinally receive at least the brush portion of the lint brush, the chamber has at least one brush cleaning pad adapted to engage the brush material and remove the fibrous substances from the brush material. The chamber further includes an air outlet spaced from the chamber opening. The air outlet is selectively connectable to a vacuum passage of a vacuum cleaner.

20 Claims, 12 Drawing Sheets

VACUUM CLEANER LINT BRUSH ATTACHMENT

This application is a continuation-in-part of U.S. patent application Ser. No. 29/356,614 filed Mar. 1, 2010 now U.S. Pat. No. DES. 654,235, entitled "Vacuum Cleaner Accessory Brush," the contents of which are incorporated herein in their entirety to the extent that it is consistent with this invention and application.

BACKGROUND

1. Field of the Art

The present invention relates to accessory tools for vacuum cleaners, and, in particular, to a tool that may be used to clean human or pet hair, or other fibrous materials. Various inventions are disclosed herein, such as a brush, a mechanism for cleaning a brush, and a combination of the foregoing. These and other inventions may be used alone, or in conjunction with any kind of suction cleaning device.

2. Description of Related Art

It is well known that human and pet hair, lint, thread, string, and many other fibrous substances, can cling to or become embedded or knotted in fabrics. For simplicity, these and other fibrous substances are referred to herein simply as "fiber." Such fibers can be difficult to remove. For example, the problem of pet hair adhering to upholstery, carpet, clothing, blankets, curtains and other materials is notoriously well-known. Fiber deposited on fabrics can change the fabric's appearance and become a physical irritant, such as by releasing dander or other material into the atmosphere, creating not only a visual nuisance, but also a potential health condition for allergy sufferers or others with sensitivity to fibers.

Various implements for removing fiber have been used in the past. For example, simple brushes have been used, as well as adhesives such as lint rollers comprising an exposed masking tape roll to which lint clings. The concept of using adhesive or clinging contact between the fiber and a cleaning tool is also known in the form of rubber-tipped brushes that grip the fibers, and plastic brushes that generate an electrostatically charged surface to which the fiber clings. For example, it is well known that an electrostatic charge can be generated as a plastic vacuum cleaner nozzle is moved on a carpet, causing loose fibers to cling to the nozzle. Rubber brushes have also been integrated into vacuum cleaner accessory tools, such as shown in U.S. Pat. Pub. No. 2006/0248680, which is incorporated herein by reference.

It is also known to form a fiber-removing brush structure having an array of small and relatively stiff directional fibers or piles that are inclined relative to the surface from which they protrude. Such brushes tend to pluck fibers from a surface when the brush is moved in one direction, and release the fibers when moved in the opposite direction. Examples of such brushes are shown and described in U.S. Pat. Nos. 3,421,171 and 3,747,152, which are incorporated herein by reference. As shown in the latter of these two patents, such brushes can be rubbed against similar or identical brushes to transfer the removed fibers from one brush to the other, or to advance the removed fibers to a receptacle via repeated rubbing. Such directional fiber material is sometimes referred to colloquially as "velour" or "velvet," and devices incorporating the same are sometimes called "lint brushes." Such brushes have been attached to floor sweepers, such as shown in U.S. Pat. No. 3,842,459, which is incorporated herein by reference. Strips of these lint brushes are also frequently placed on one or both sides of vacuum cleaner inlet nozzles, with the fibers being inclined towards the inlet to help confine and capture fibers.

Where lint brushes have been used adjacent vacuum cleaner inlets, the air passing through the vacuum cleaner inlet tends to clean fibers from the lint brush. It is also known to provide arrangements in which a brush, such as a pet-grooming brush, is connected to a vacuum to clean fibers during brushing, and then reversed to clean the brush after grooming is complete. See, for example, U.S. Pat. No. 7,159,274, which is incorporated herein by reference. Features for cleaning a brush or a duster with a vacuum are also shown in U.S. Pat. Nos. 2,240,107, 6,341,402, 6,446,293, 6,530,114 and 7,024,723, as well as U.S. Pat. Pub. No. 2006/0096055, which are also incorporated herein by reference.

While various cleaning alternatives are known in the art, it has been found that such devices suffer from various problems. For example, typical cleaning devices that are connected to vacuum nozzles can be cumbersome to use, and are not adapted for use in areas that are remote from the vacuum. Also, lint brushes often accumulate dirt and fibers, despite being located adjacent a vacuum inlet nozzle. Other deficiencies are also believed to exist. The present invention provides unique alternatives to known cleaning devices, and various new and useful features that may be used with otherwise conventional cleaning devices.

SUMMARY

In one exemplary aspect, there is provided a vacuum cleaner lint brush accessory system having a lint brush and cradle. The lint brush has longitudinally opposed handle and brush portions. The brush portion has a brush material adapted to remove fibrous substances from a surface to be cleaned. The cradle has a chamber opening leading to a chamber. The chamber extends in the longitudinal direction and is adapted to longitudinally receive at least the brush portion of the lint brush, the chamber has at least one brush cleaning pad adapted to engage the brush material and remove fibrous substances removed from the surface to be cleaned from the brush material. The chamber further includes an air outlet spaced from the chamber opening. The air outlet is selectively connectable to a vacuum passage of a vacuum cleaner.

In another exemplary aspect, there is provided a lint brush having a handle portion and a brush portion. The brush portion is connected to the handle portion and has opposed front and back surfaces and a side surface connecting the front surface to the back surface. A brush material is located on at least one of the front and back surfaces. The brush material includes a directional pile adapted to lift fibrous substances from a surface to be cleaned when the directional pile is moved in a pick-up direction. A friction material is located on the side surface. The friction material is adapted to pull fibrous materials from the surface to be cleaned when the friction material is rubbed against the surface to be cleaned.

In another exemplary aspect, there is provided a method for cleaning. The method includes accessing a brush having a handle portion and a brush portion extending longitudinally from the handle portion. The brush portion has a brush material thereon. The method also includes moving the brush against a surface to be cleaned to remove fibers from the surface to be cleaned, inserting at least the brush portion of the brush through a chamber opening and into a chamber that has at least one cleaning pad located proximal to the chamber opening, and removing the brush portion of the brush from the chamber to thereby engage the brush material with the at least one cleaning pad to strip the fibers from the brush material. The method also includes activating a vacuum source connected to the chamber to evacuate the fibers.

The recitation of this summary of the invention is provided for exemplary and illustrative purposes, and is not intended to limit the scope of the invention.

BRIEF DESCRIPTION OF THE DRAWINGS

Purposes and advantages of the exemplary embodiments of the invention described herein will be apparent to those of ordinary skill in the art from the following detailed description in conjunction with the appended drawings in which like reference characters are used to indicate like elements.

DETAILED DESCRIPTION OF EXEMPLARY EMBODIMENTS

The following description is intended to convey an understanding of the inventions disclosed herein by describing a number of exemplary embodiments of vacuum cleaner components and systems. It should be appreciated, however, that the present invention is not limited to these exemplary embodiments and details, the appended figures, the summary of the invention, the abstract, or to the other specific disclosures herein. It is further understood that one possessing ordinary skill in the art, in light of known systems and methods taken in conjunction with the teachings herein, would appreciate the use of the invention for its intended purposes and benefits in any number of alternative embodiments, depending upon specific design needs and other considerations.

The terminology used herein is for the purpose of describing particular embodiments only, and is not intended to limit the scope of the present invention. As used throughout this disclosure, the singular forms "a," "an," and "the" include the plural unless the context clearly dictates otherwise. Thus, for example, a reference to "a fitting" includes a plurality of such fittings, as well as a single fitting and equivalents or variations thereof known to those skilled in the art. Unless defined otherwise, all technical and scientific terms used herein have the same meanings as commonly understood by one of ordinary skill in the art to which this invention belongs.

Generally speaking, the lint brush cleaning devices of the various exemplary embodiments described herein have a lint brush for removing fibrous substances such as pet hair, lint, and the like from a fabric surface, and a brush cradle that attaches to a vacuum source and is adapted to receive and clean the lint brush by removing the fibrous substances from the brush. The brush does not include an air passage or facilities to connect it directly to a suction hose, but such may be provided if desired. In addition, the brush cradle may be permanently mounted to a vacuum cleaner body, or provided as a separate part that can be integrated into a pre-existing vacuum cleaner system at various locations, such as at an intermediate location along a cleaning head wand, on the side of an upright vacuum cleaner, on a vacuum hose, on a central vacuum, and so on.

In the various exemplary embodiments, a lint brush cleaning device 10 comprises a lint brush 200 adapted to remove fibrous substances from a surface. As used herein "fibers" or "fibrous substances" includes debris such as human or pet hair, dust, lint, string, thread and other such materials that collect on surfaces. As used herein when referring to surfaces being cleaned, "surface" includes fabric or fabric-covered surfaces including clothing, upholstery, carpet, blankets, curtains, and other such surfaces on which fibers tend to collect, and can also include hard surfaces, such as tile, linoleum, wood, and the like.

Figure 1:
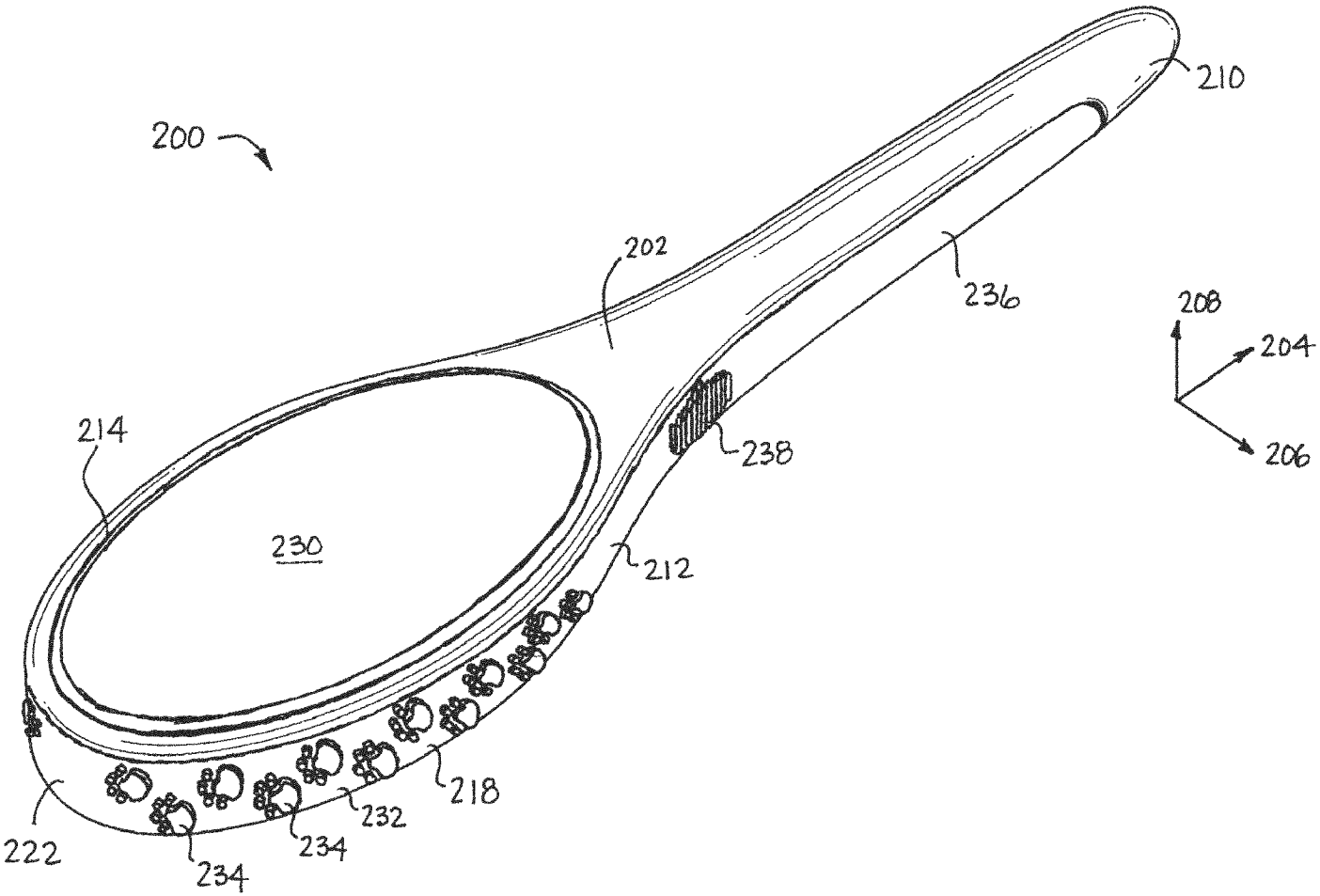
FIG. 1 is a perspective view of a lint brush in accordance with an exemplary embodiment.
Figure 2:
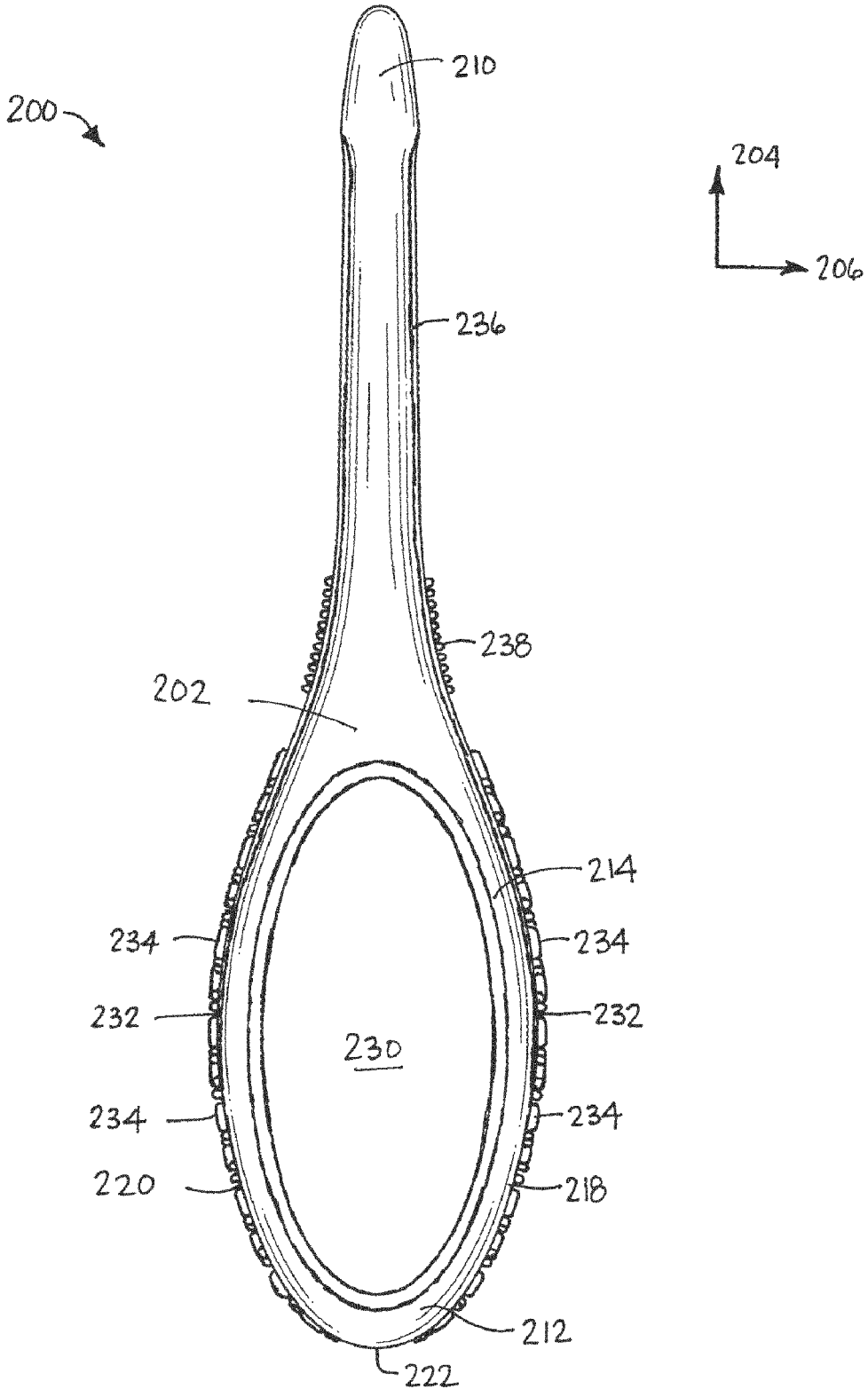
FIG. 2 is a front view of the lint brush of FIG. 1.
Figure 3:
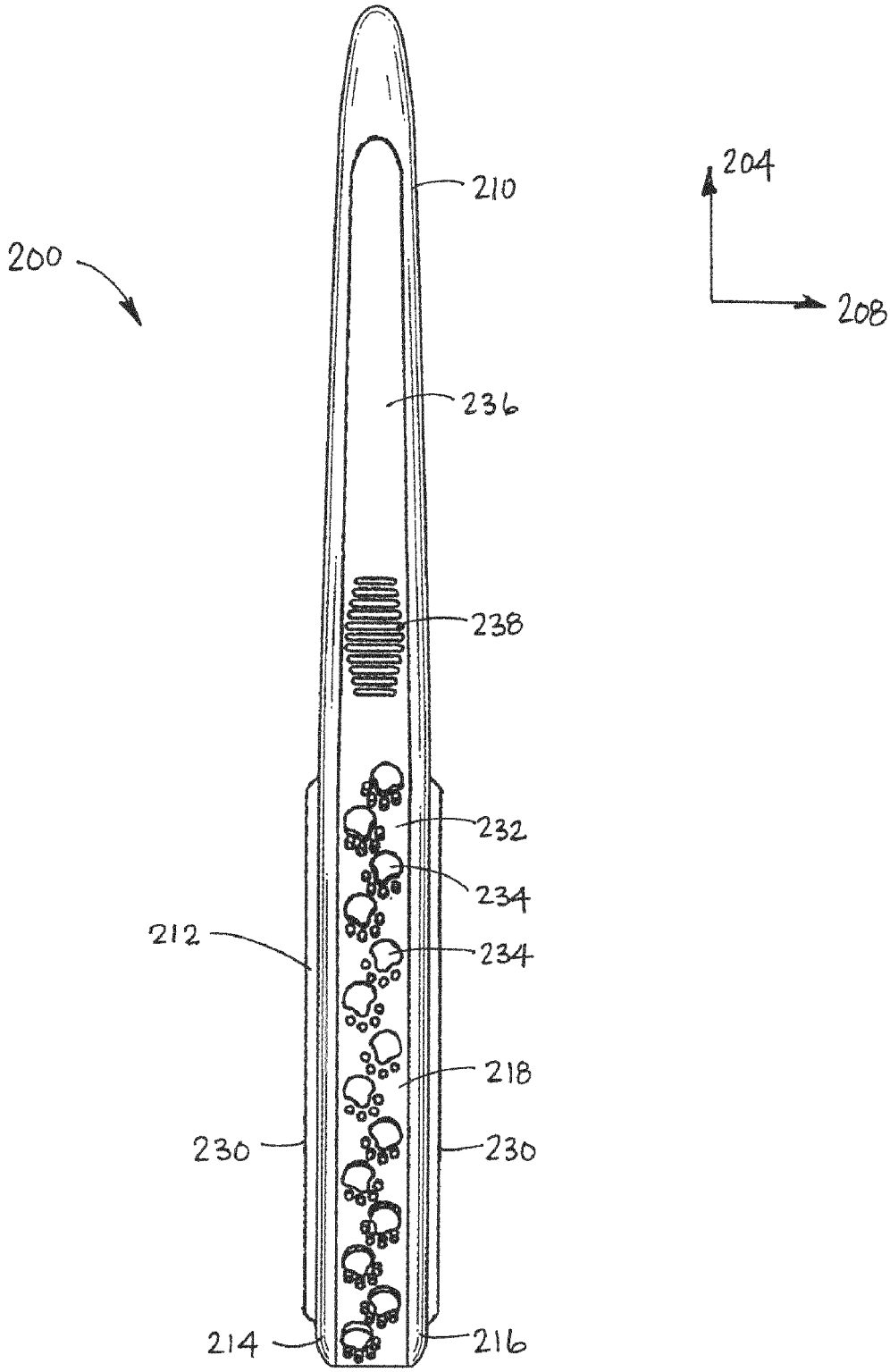
FIG. 3 is a side view of the lint brush of FIG. 1.

Referring to FIGS. 1-3, in one exemplary embodiment, a lint brush 200 has a body 202 having a longitudinal direction 204, a transverse direction 206, and a z-direction 208. The body 202 has a handle portion 210 and a brush portion 212. The brush portion 212 includes a brush material 230 adapted to remove fibrous substances from a surface to be cleaned. The handle portion 210 extends longitudinally from brush portion 212, providing a gripping surface for the user of the lint brush 200. Handle portion 210 may be integrally formed with brush portion 212, or it may be formed separately and joined with the brush portion 212. As will be appreciated by one having ordinary skill in the art, handle portion 210 may include contours, gripping elements, and/or other devices configured to improve the user's ability to grip the lint brush 200.

In an exemplary embodiment, brush portion 212 has a front surface 214 and a back surface 216 that are joined by a side surface. The side surface may include a first side surface 218, a second side surface 220 generally opposed the first side surface 218, and an end surface 222 that joins the two side surfaces 218, 220 and is located longitudinally opposite the handle portion. The front and back surfaces 216, 218 are shown as exemplary ovate surfaces, but other shapes may be used, and the surfaces need not be flat, as shown. The side and end surfaces 218, 220, 222 are formed as a continuous curved face in the exemplary embodiment, but they may have different shapes and be discrete from one another.

A brush material 230 may be disposed on one or more of the brush surfaces, and adapted to remove fibrous substances from surfaces. For example, brush portion 212 may have a brush material 230 disposed on the front surface 214 and on the back surface 216. In addition, the shown exemplary embodiment includes a friction strip 232 that covers the side and end surfaces 218, 220, 222, and may include one or more protrusions 234 that extend from the friction strip 232 to contact a surface being cleaned and loosen or remove fibers by friction. The friction strip 232 may extend along the handle portion 210 to provide grips 236 on either side of the handle 210, and may include raised grips 238 to provide enhanced gripping or comfort. If desired, the strip portion of the friction strip 232 may be removed or placed below the outer shell of the handle, leaving just the protrusions 234 exposed. Alternatively, the protrusions 234 may be omitted or changed into raised strips or simply an arced contour. For example, the protrusions 234 may be omitted, and the friction strip 232 may comprise a bowed-out strip that extends laterally from the brush 200.

In an exemplary embodiment, the brush material 230 may be a directional material, i.e., a material that can be drawn in a first direction (a "pick-up direction") across a surface to be cleaned to pick up fibrous substances from the surface, and drawn in an opposite direction (a "release direction") across the surface to release the fibrous substances from the brush material 230. For example, the brush material 230 may be a directional pile fabric having a plurality of short fibers that lean in one direction. An exemplary brush material is described in U.S. Pat. No. 3,421,171, the disclosure of which is incorporated herein by reference in its entirety. As described, the brush material 230 may be a dimensional woven nylon pile velvet created by cutting intertwined yard threads. The pile surface is heat set in a specific direction to provide directional uniformity. When the brush material 230 is drawn in one direction across a surface to be cleaned, it picks up fibrous substances and other debris from the surface. Dragging the brush material 230 in an opposite direction across a surface removes some or all of the collected lint and debris from the fabric.

The friction strip 232 may comprise any relatively high-friction material or material that frictionally rubs fabrics to help remove fibers. Suitable materials may include natural rubber, or natural or man-made polymers. Potentially suitable materials are shown in U.S. Pat. Pub. No. 2006/0248680, which is incorporated herein by reference.

In exemplary embodiments, lint brush 200 may have brush material 230 disposed on the front surface 214 and on the back surface 216. This brush material 230 may be directional in any number of directions, but in one embodiment it is directional in the transverse direction 206 so that lateral movement along the transverse direction 206 in one direction is the pick-up direction and movement in the opposite direction is the release direction. In exemplary embodiments, the directional brush material 230 disposed on the front surface 214 may be oriented in the same direction as the brush material 230 on the back surface 216 (i.e., so when lint brush 200 is flipped over, the pick-up direction is reversed relative to the user). In other exemplary embodiments, the directional brush material 230 on the front surface 214 may be oriented in the opposite direction as the brush material 230 on the back surface 216 (i.e., so when lint brush 200 is flipped over, the pick-up direction is the same relative to the user).

In other exemplary embodiments, the brush material 230 may have other orientations or patterns, and may be located elsewhere on the brush 200. The material 230 also may be interspersed with friction materials that remove fibrous substances or debris by friction. In other exemplary embodiments, a directional material may be provided on the narrow sides or end of the brush, either in strips or as discrete patches. In various exemplary embodiments, the lint brush may include a combination of multiple types of lint removing materials, such as an alternating pattern of rubber ridges or bumps and velour strips. Other variations will be understood by persons of ordinary skill in the art in view of the present disclosure.

It has been found that providing a directional lint-removing material 230 on the large, flat front and rear surfaces 214, 216, in combination with a friction strip 232 on the narrow side and end surfaces 218, 220, 222 of the brush 200, is a particularly useful arrangement. Prior brushes typically used a single hair-removing material, and did not obtain the benefits the combined structure. In use, the exemplary brush 200 can be used by applying the lint-removing material 230 to the surface being cleaned during general use by moving it laterally in a sweeping motion. This may help clean a large area relatively quickly. When the user encounters narrow spaces that do not accommodate the above-described sweeping motion (e.g., corners or crevices), or finds fibers that resist removal by the directional material 230, the user can employ the friction strip 232 to remove such fibers.

The brush material 230 and friction strip 232 may be attached to the brush 200 by any suitable means. For example, the brush material 230 may be permanently attached to selected portions of the brush portion 212 of the lint brush 200 by adhesives, mechanical connections, or chemical bonds. The friction strip 232 may be molded in place, overmolded, or made separately and connected to the brush 200, such as by capturing it in place within a groove formed on the brush 200 or adhering or bonding it to the brush 200. In other embodiments, brush material 230 or friction strip 232 may be releasably affixed to the brush portion 212, so that one or both may be removed and replaced such as when it becomes ineffective. In exemplary embodiments, the brush material 230 may be substantially entirely attached to the brush portion 212. For example, brush material 230 may have a backing surface that is substantially entirely bonded to a surface of the brush portion 212. In other embodiments, the brush material 230 may have one or more portions that are selectively detached from the brush portion 212. For example, the brush material 230 may be bonded to a surface of the brush portion 212 at discreet points or lines.

In exemplary embodiments, brush material 230 may have a rigid or resilient three-dimensional backing material, such as a foam material, that supports the brush material 230 and enables it to better contour to the surface to be cleaned. The backing material may, for example, comprise a plate-like structure around which the brush material 230 is wrapped. The plate may be mounted in a hole in the brush 200, such as by snap-fitment or fasteners, and the plate and brush material 230 may be removable as a unit for replacement. The backing material also may be resiliently mounted to the brush, to permit some relative movement between the brush material 230 and the brush housing. Other variations will be understood by persons of ordinary skill in the art in view of the present disclosure.

Figure 4:
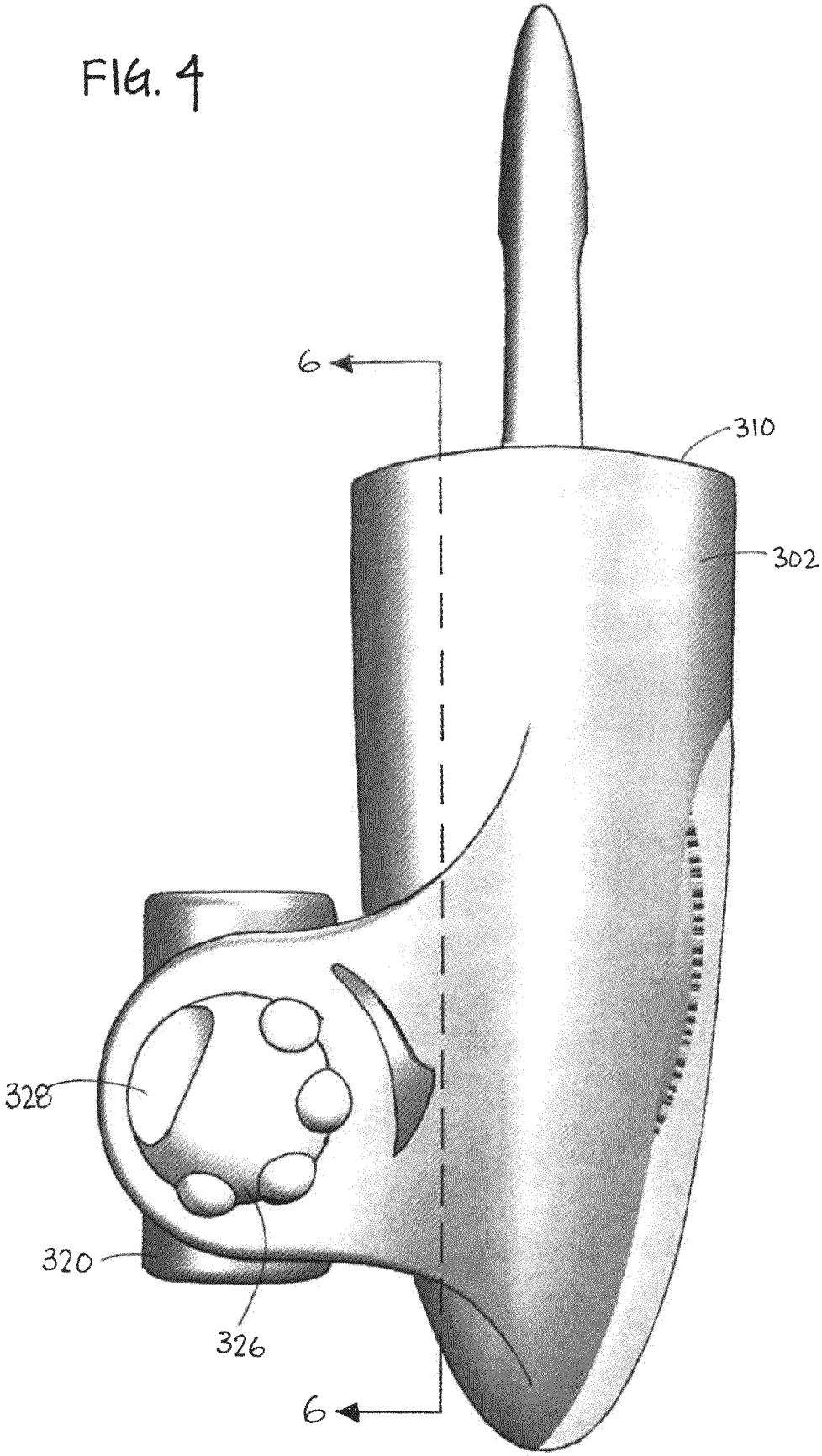
FIG. 4 is a front elevation view of a brush cradle in accordance with an exemplary embodiment.
Figure 5:
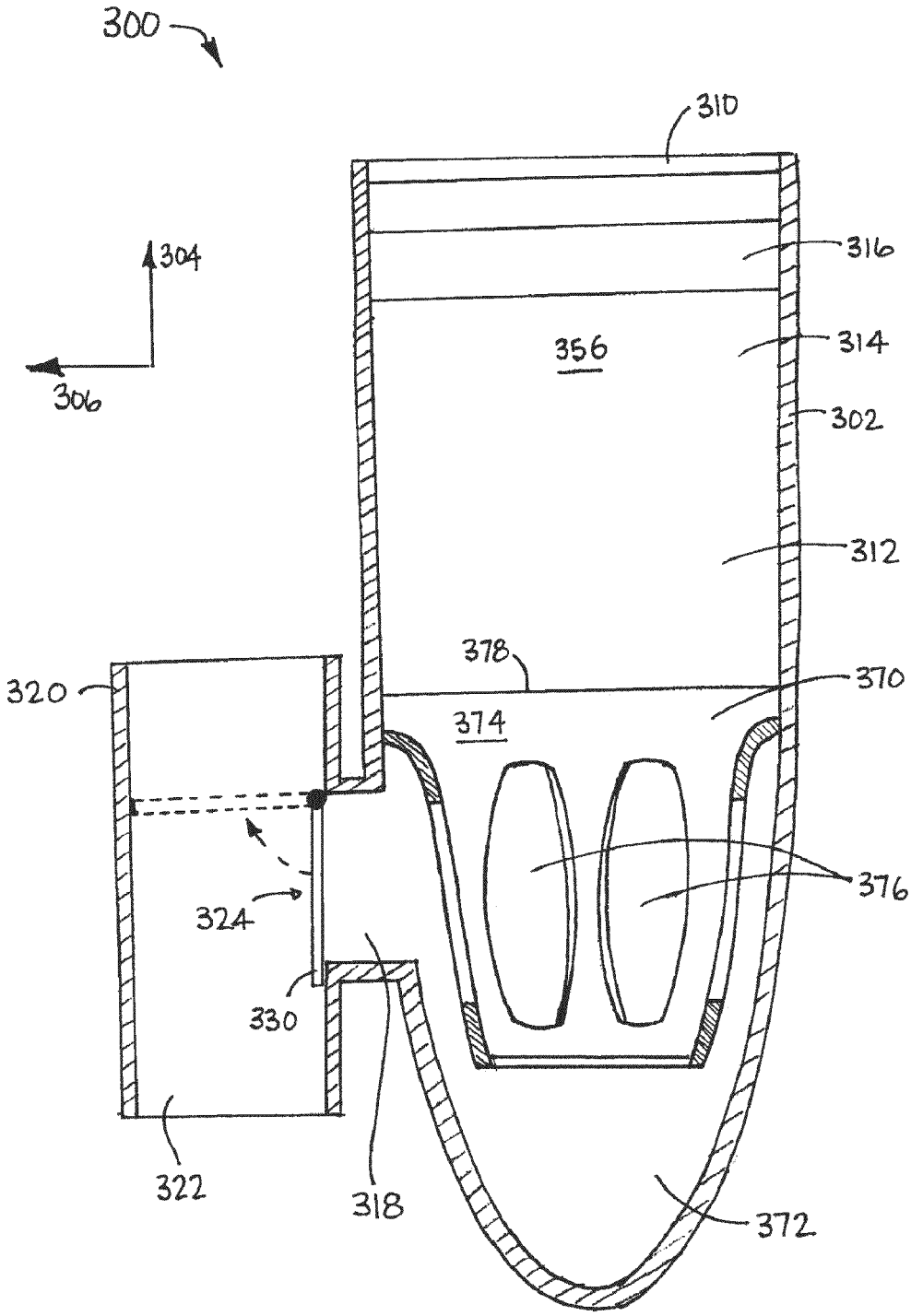
FIG. 5 is a cutaway front elevation view of the brush cradle of FIG. 4, as viewed along line 5-5 of FIG. 6.
Figure 6:
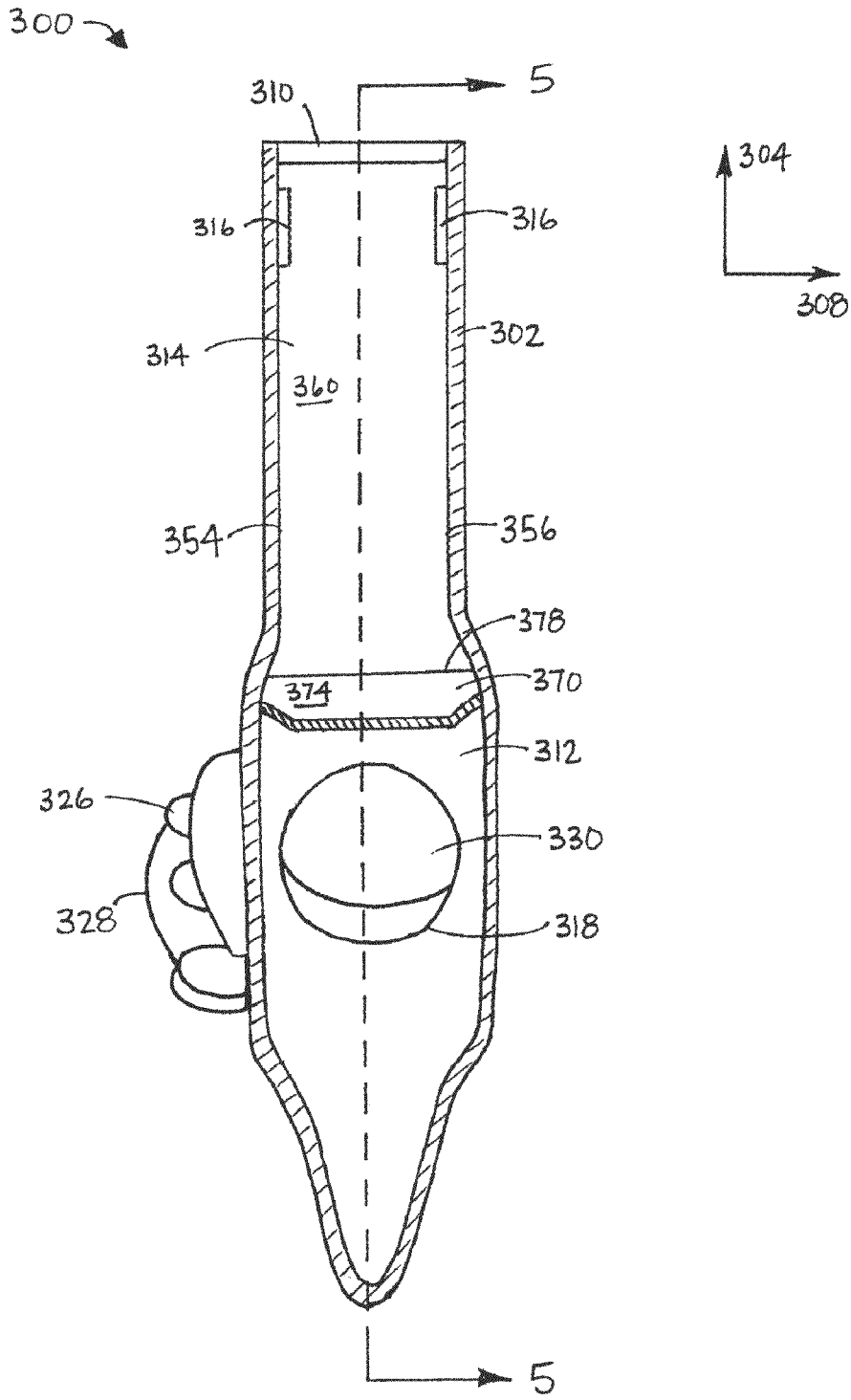
FIG. 6 is a cutaway side elevation view of the brush cradle of FIG. 4, as viewed along line 6-6 of FIG. 4.
Figure 8:
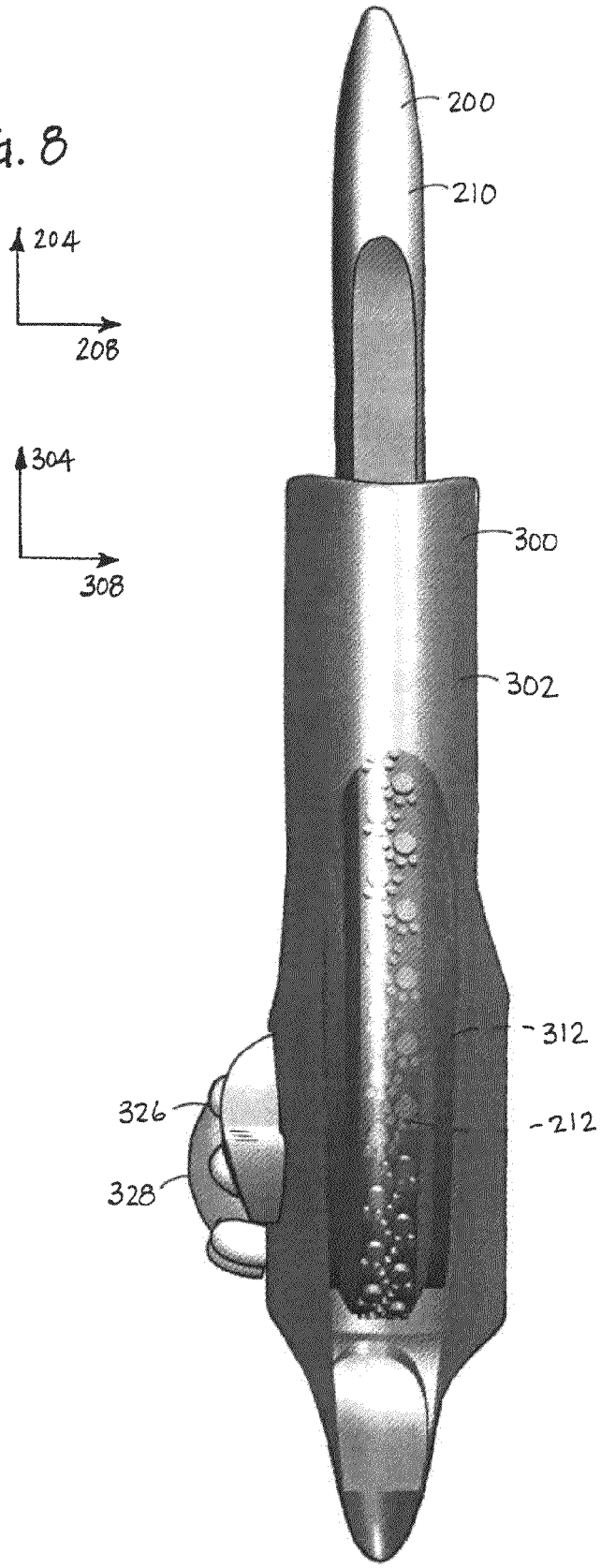
FIG. 8 is a side elevation view of a lint brush and a brush cradle in accordance with an exemplary embodiment.
Figure 9:
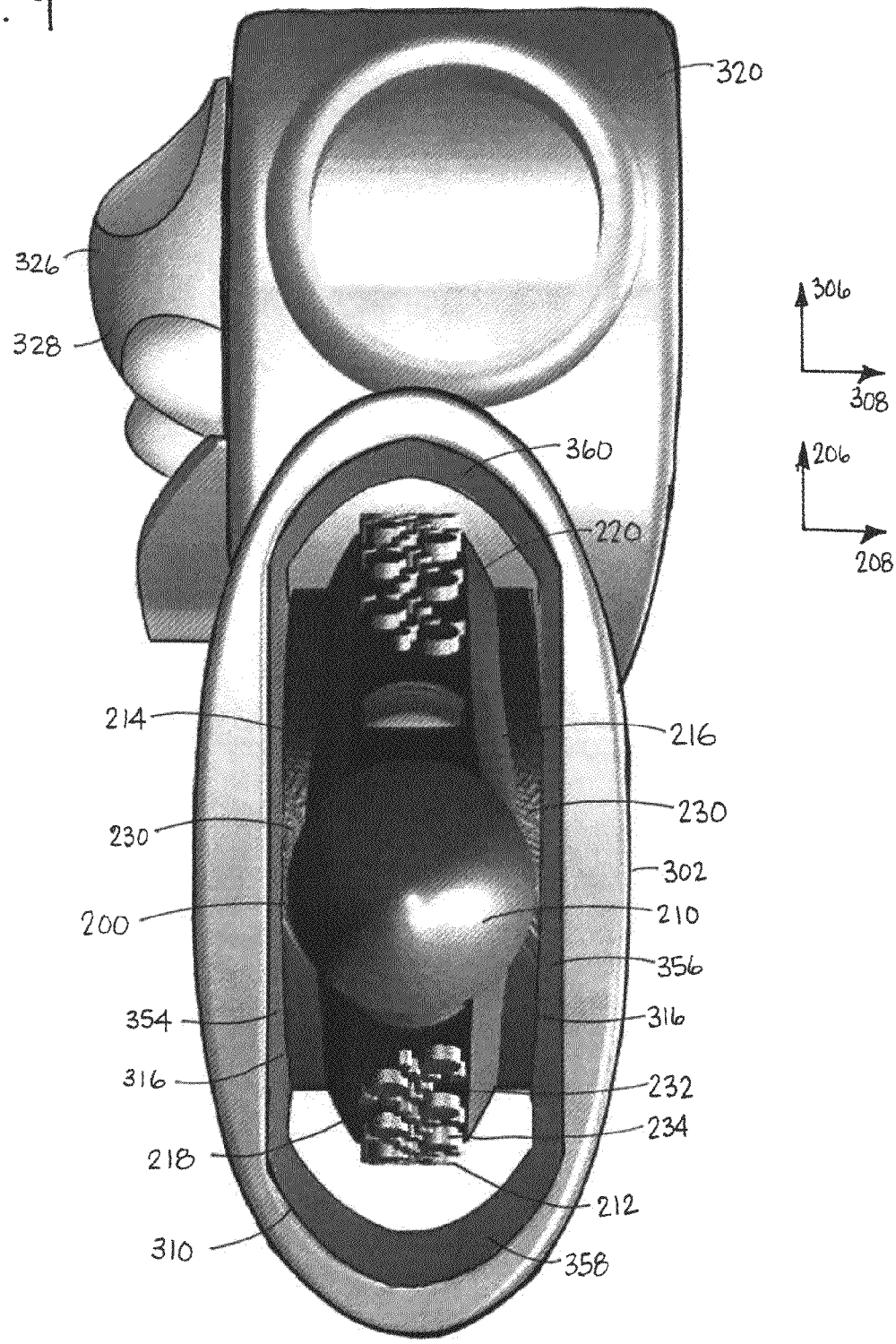
FIG. 9 is a top view of the lint brush and brush cradle of FIG. 8.
Figure 10:
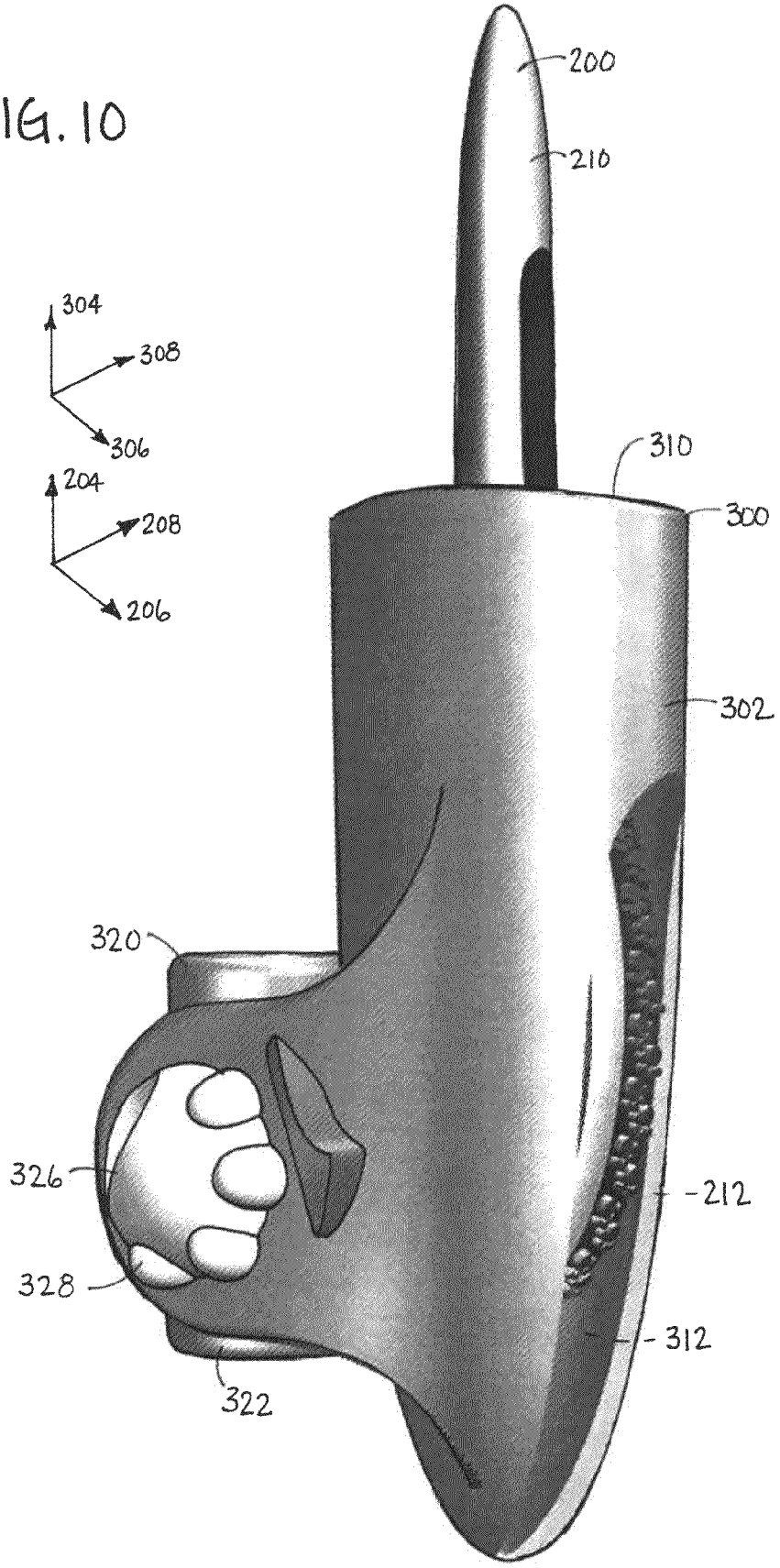
FIG. 10 is a perspective view of the lint brush and brush cradle of FIG. 8.

In exemplary embodiments, the lint brush 200 may be inserted into a brush cradle 300 for storage and/or to remove the collected fibrous substances and debris from the brush material 230. Referring to FIGS. 4-6, an exemplary brush cradle 300 may have a housing 302 and a longitudinal direction 304, a transverse direction 306, and a z-direction 308. Housing 302 may have a chamber opening 310, leading to a chamber 312 inside the housing 302. Referring to FIGS. 8-10, lint brush 200 may be inserted in the opening 310 of the brush cradle 300, such that the longitudinal direction 204 of the lint brush 200 is generally aligned with the longitudinal direction 304 of the brush cradle, and the brush portion 210 is at least partially received in the chamber 312. Once inserted, the handle portion 212 of the lint brush 200 may extend outward for easy grasping by one desiring to deploy the lint brush 200.

In various exemplary embodiments, the opening 310 of chamber 312 may have a size and shape sufficient to receive the brush portion 212 of lint brush 200. For example, referring to FIG. 9, the chamber opening 310 may have transverse and z-direction dimensions that are larger than the corresponding transverse and z-direction dimensions of the lint brush 200. In exemplary embodiments the size and shape of chamber opening 310 are configured to provide a predetermined clearance distance between the outer surfaces of the lint brush 200 and the perimeter of the opening 310.

Likewise, in exemplary embodiments the chamber 312 may have a size and shape sufficient to receive the brush portion 212 of lint brush 200. For example, referring to FIGS. 8 and 10, the chamber 312 may have a longitudinal dimension that is larger than the corresponding longitudinal dimension of the brush portion 212, so that the entire brush portion 212 may fit entirely within the chamber 312. Referring to FIG. 9, when the lint brush 200 is inserted into the brush cradle, the inner surface 314 of chamber 312 may have a front surface 354 facing the front surface 214 of the lint brush 200, a back surface 356 facing the back surface 216, a first side surface 358 facing first side surface 218, and a second side surface 360 facing second side surface 218 of the lint brush 200.

In exemplary embodiments, a brush cleaning pad 316 may be disposed on one or more of the inner surfaces 314 of the chamber 312. The brush cleaning pads 316 are configured to engage the brush material 230, when lint brush 200 is inserted into the chamber 312, and to remove fibrous substances and other debris from the brush material 230. The brush cleaning pads 316 may be made of any material suitable for removing fibrous substances or debris from the brush material 230. For example, the brush cleaning pads 316 may be a directional pile fabric, as described above with respect to the lint brush 200, which has directional piles of fibers facing toward the brush materials 230 of lint brush 200. One having ordinary skill in the art will appreciate the types of material that may be used in the brush cleaning pads 316 to effectively remove fibrous substances and debris from the brush materials 230 of the lint brush 200.

In one exemplary embodiment, the brush cleaning pads 316 have a directional material that is oriented at least partially in the longitudinal direction 304. For example, directional brush cleaning pads 316 may have a pick-up direction oriented longitudinally downward, and a release direction that is oriented longitudinally upward. Stated differently, the piles may be angled downward. Orienting the direction of the brush cleaning pads 316 in this configuration and using the same with the exemplary brush 200 having its brush material oriented in the lateral direction, such as described above, may enable the brush material 230 to clean the brush cleaning pads 316 when the lint brush 200 is inserted into the chamber 312, and the brush cleaning pads 316 to clean the brush material 230 when the lint brush is removed from the chamber 312. In other words, when lint brush 200 is inserted into the brush cradle 300, brush material 230 rubs against brush cleaning pad 316 in a downward direction (the release direction of the brush cleaning pad 316), sweeping fibrous substances and debris that has collected on the brush cleaning pad 316 (such as from prior use) into the chamber 312. When the lint brush 200 is thereafter removed from the chamber 312, the brush material 230 rubs against the brush cleaning pad 316 in an upward direction (the pick-up direction of the brush cleaning pad 316), whereby brush cleaning pad 316 cleans the brush material 230 by collecting the fibrous substances and debris that were on the brush material 230, leaving the brush material 230 substantially clean.

It will be appreciated that the greatest fiber stripping capability may be achieved when the brush cleaning pad 316 has brush piles that are oriented in the longitudinal direction 304. However, orienting the brush piles longitudinally may create the greatest frictional force between the brush cleaning pads 316 and the corresponding brush materials 230, when the lint brush 200 is removed from the chamber 312. This frictional force may be reduced by orienting the brush piles so that they are at an angle to the longitudinal direction 304. While the fiber stripping capability of the brush cleaning pad 316 may be reduced when the brush piles are oriented at an angle to the longitudinal direction 304, the brush cleaning pad 316 may still provide suitable fiber stripping capability. It may be desirable to modify the angles of the brush piles to provide a brush cleaning pad 316 having a suitable frictional force and fiber stripping capability. In an exemplary embodiment, the brush cleaning pads 316 may have brush piles that are at an angle of about 0 degrees to about 45 degrees from the longitudinal direction 304. In another embodiments, the brush cleaning pads 316 may have brush piles that are at an angle of about 45 degrees to about 90 degrees from the longitudinal direction 304 (from about 0 degrees to about 45 degrees from the transverse direction 306).

In exemplary embodiments, the brush cleaning pads 316 have a size and shape sufficient to clean one or more brush materials 230 of the lint brush 200. For example, the upper edge of brush cleaning pads 316 may be located on the inner surface 314 of chamber 312 approximately 15 millimeters (mm) down from the leading edge of the opening 310 to the chamber 312, and the brush cleaning pads 316 may have a longitudinal dimension of approximately 25 mm. In exemplary embodiments, a plurality of brush cleaning pads 316 may be disposed in the longitudinal direction on the inner surface 314 of chamber 312 to clean the brush materials 230. In exemplary embodiments, the brush cleaning pads 316 have a width that is equal to or greater than the width of the lint brush 300, so that each brush cleaning pads 316 may clean an entire brush material 230 of the lint brush 300. In other exemplary embodiments a plurality of brush cleaning pads 316 may be disposed in the transverse direction along the inner surface 314 of the chamber 312, to clean the brush materials 230. One having ordinary skill in the art would understand how to configure the size and shape of the brush cleaning pads 316 for the purpose described herein.

The brush cleaning pads 316 may be permanently or temporarily affixed to the inner surface of chamber 312. For example, the brush cleaning pads may be adhesively, mechanically, or chemically bonded to the inner surface of chamber 312. In other embodiments, brush cleaning pads may be releasably affixed to the inner surface of chamber 312, so that the brush cleaning pads may be removed and replaced such as when they become ineffective. In exemplary embodiments, the brush cleaning pads 316 may be substantially entirely attached to the inner surface of chamber 312. For example, brush cleaning pads may have a backing surface that is substantially entirely bonded to the inner surface of chamber 312. In other embodiments, the brush cleaning pads 316 may have one or more portions that are selectively detached from the inner surface of chamber 312. For example, the brush cleaning pads 316 may be bonded to the inner surface of chamber 312 at discreet points or lines.

In exemplary embodiments, brush cleaning pads 316 may have a resilient backing material, such as a foam or rubber material. The resilient backing material may permit some movement of the brush pad 316 enabling the brush pad 316 to better contour to the surfaces of the lint brush 200, and accommodate broader tolerances for dimensions of the chamber 312, and the lint brush 200. The resilient backing material also may help to equalize the pressure and frictional forces across the surface of the brush cleaning pad 316 when it engages with the brush material 320, such as when the lint brush 200 is inserted into and removed from the chamber 312. In one exemplary embodiment, a resilient backing material, such as a foam material, may be provided between the brush cleaning pad 316 and the inner surface 314 to which is attached. In another exemplary embodiment, the brush cleaning pads 316 may be mounted to an inner surface 314 that is flexible and resilient to provide a similar effect. Other variations will be understood by persons of ordinary skill in the art in view of the present disclosure.

Figure 7:
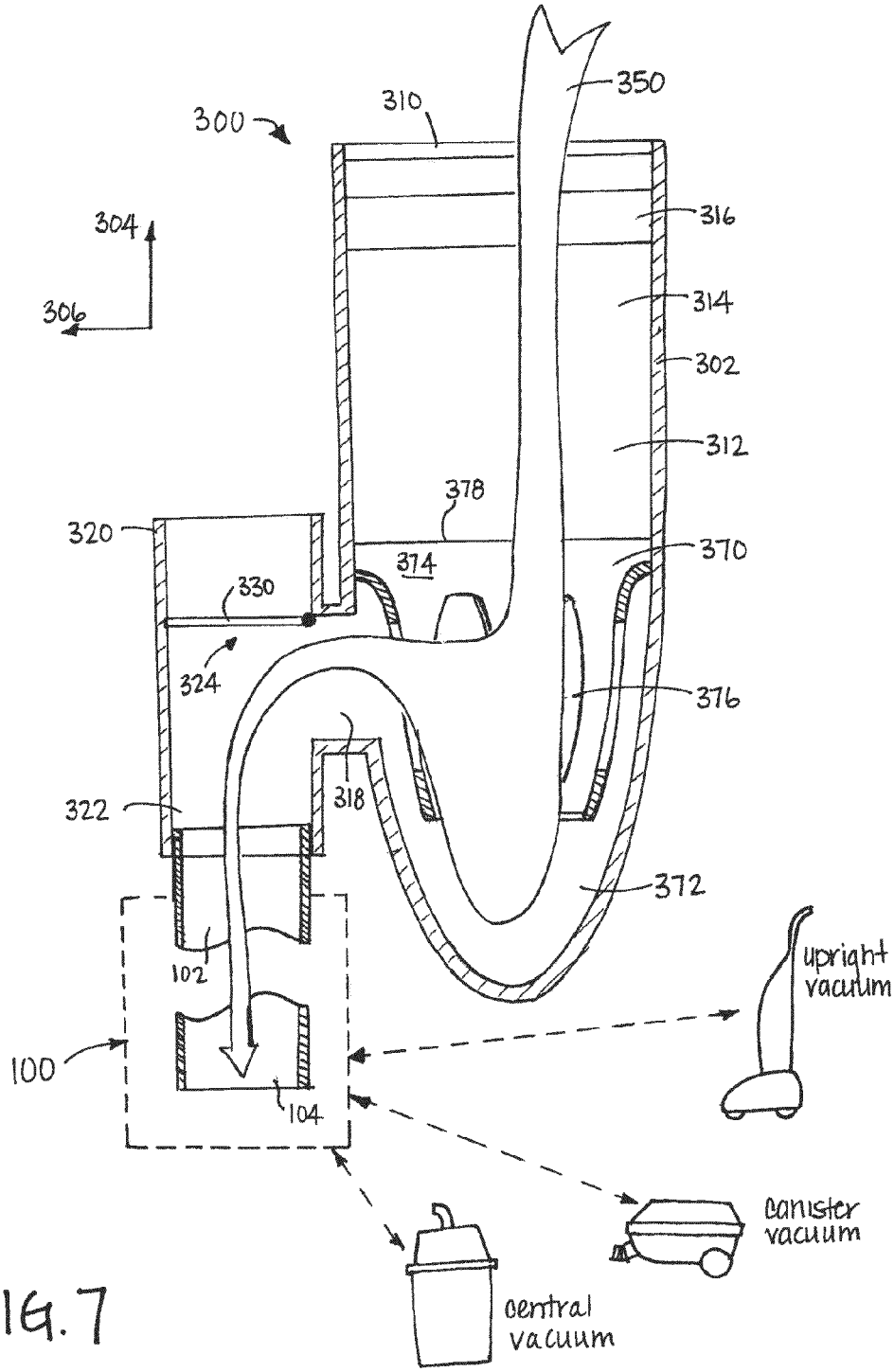
FIG. 7 is a schematic view of a brush cradle attached to a vacuum system in accordance with an exemplary embodiment.

In exemplary embodiments, when lint brush 200 is inserted into chamber 312, fibrous substances and debris collect in the brush cleaning pads 316 and in the chamber 312. Referring to FIG. 7, in exemplary embodiments, the chamber 312 may be in selective fluid communication with a vacuum cleaner 100, providing an air flow path from the opening 310 through the chamber 312 to a vacuum source 104, so that the fibrous substances and debris may be conveyed into the vacuum cleaner 100 for disposal. In exemplary embodiments, vacuum cleaner 100 may be a hand-held vacuum cleaner, a full-sized upright, a canister vacuum, a stick-type vacuum cleaner; a central vacuum system, and so on. Having read this disclosure, one having ordinary skill in the art would understand the various devices that would be suitable for vacuum cleaner 100 in the exemplary embodiments.

Generally speaking, an exemplary vacuum cleaner 100 has a vacuum source in fluid communication with an inlet port. The vacuum source can comprise a blower, blower/filter combination, or the like adapted to provide a suction force to pull an air stream entrained with debris from the inlet port toward the vacuum source. The vacuum cleaner can also be provided with a debris collection device, such as a filter, canister, bag or the like, between the inlet port and the vacuum source to separate fibrous substances and debris from the air stream and/or collect fibrous substances and debris from the air stream. For example, the vacuum cleaner may be provided with a filter cartridge to separate debris from the air stream. In addition or alternatively, the vacuum source may be provided with a canister for cyclone and/or pressure drop separation of particulate from the air stream. Still further, the vacuum source may be provided with a debris bag or other container (not shown) for storing debris separated from the air stream. One having ordinary skill in the art would understand how to configure a vacuum cleaner to separate fibrous substances and debris from an air stream, for disposal. Examples of suitable vacuum cleaners are found in U.S. Pat. No. 6,910,245 and U.S. Patent Publication Nos. 2005/039295 and 2006/0278087, all of which are incorporated by reference herein.

Referring to FIGS. 4-6, in an exemplary embodiment, brush cradle 300 may have an air outlet such as passageway 318 that is adapted to be in selective fluid communication with a vacuum source 104. A fitting 320 may be provided intermediate the passageway 318 and the vacuum source 104 to operably couple air passageway 318 and the inlet port 102 of vacuum cleaner 100. Fitting 320 may be integrally formed with the housing 302, or it may be separately formed and operably coupled with housing 302. In exemplary embodiments, fitting 320 may have an air outlet 322 that is adapted to mechanically couple with the inlet port 102 of the vacuum cleaner 100. For example, air outlet 322 may have a tubular fitting that provides an interference fit with a tubular inlet port 102. When the vacuum source 104 is activated, air may be drawn in the flow path schematically illustrated by arrow 350 (FIG. 7) through the opening 310, through chamber 312, passageway 318, outlet 322, and inlet port 102, toward the vacuum source 104. Any fibrous substances or debris in the chamber 312, may be entrained in the air flow toward the vacuum source 104.

Referring to FIG. 5, in exemplary embodiments, brush cradle 300 may have a sleeve 370 disposed within the chamber 312 between the opening and the air passageway 318. The sleeve keeps the lint brush 200 spaced from the passageway 318 and a portion of the inner surface 314 of the chamber 312. For example, sleeve 370 may have an upper edge 378 that is operably attached to the inner surface 314 of the brush cradle 300 and may have surface 374 extending downward from the upper edge 378, in a generally concave configuration. The sleeve 370 may have a size and shape that may receive the brush portion 212 of the lint brush 200. In exemplary embodiments, sleeve 370 may support the lint brush 200 when in the chamber 312. The surface 374 may be spaced apart from the inner surface 314, creating a trap 372 below the sleeve 370. In exemplary embodiments, the sleeve 370 may have a plurality of holes 376 disposed therein, permitting air flow through the sleeve 370, even when the lint brush 200 is in the chamber 312. In addition, the holes 376 may permit the passage of fibrous substances and debris through the sleeve 370, so that the fibrous substances and debris can collect in the trap 372 without being re-deposited on the brush material 230 of the lint brush 200. In exemplary embodiments, the fibrous substances and debris that collect in the trap 372 may be entrained in the air flow from the chamber opening 310 through the sleeve 370 into the passageway 318 and eventually toward the vacuum cleaner 100.

Referring to FIGS. 5 and 6, in exemplary embodiments, the brush cradle 300 may include a valve 324 adapted to control the fluid communication between the chamber 312 and the air outlet 322. For example, the valve 324 may be set to an open position, permitting full fluid communication between the chamber 312 and the air outlet 322. Alternatively, the valve 324 may be set to a closed position wherein the valve 324 substantially inhibits or substantially prevents fluid communication between the chamber 312 and the air outlet 322. Where the fitting 320 is disposed along a functioning air passage of the vacuum cleaner (e.g., a passage from a suction nozzle to the vacuum source), the valve 324 may block air flow through the fitting 320 when it is in the open position to cut off normal vacuuming operation.

In exemplary embodiments, the valve 324 may be any type of valve that is suitable for controlling the fluid flow between the chamber 312 and the air outlet 322. For example, the valve 324 may have a rotating flap 330 that is pivotally attached to the housing 302. The flap 330 may have end portion adapted to abut the interior surface of the air passageway 318 when the valve 324 is in a closed position. Although not shown, other valve arrangements may be employed that are adapted to inhibit or prevent fluid communication between the chamber 312 and the air outlet 322. For example, the valve 324 may be a ball valve, a sliding valve, or the like. Examples of a suitable valves are shown in U.S. Pat. Nos. 6,341,402 and 7,293,326 and U.S. Publication Nos. 2008/0209668 and 2009/000054, which are incorporated by reference herein in their entireties. One having ordinary skill in the art will appreciate the various types of valves that are suitable for this purpose.

In various exemplary embodiments, the valve 324 may be provided with a valve control 326. For example, the valve control 326 may have a hand lever 328 or dial disposed on the outside of the housing 302, enabling manual opening and closing of the valve 324 by a user. While the control is described as a lever, it will be appreciated that the control may comprise other elements, such as a sliding switch, rotatable switch, motion sensor or the like. In other exemplary embodiments, the valve control 326 may be automated. In one embodiment, the valve control 326 may have a biasing member, such as a torsion spring, that biases the valve 324 toward the open or the closed position. For example, the valve 324 might be biased to inhibit or substantially prevent fluid passage from the chamber 312 unless the valve 324 is at least partially rotated to an open position.

In exemplary embodiments, the fitting 320 may be adapted to provide a rigid connection between the brush cradle 300 and the vacuum cleaner 100. For example, fitting 320 may be a substantially rigid tubular member structured to support the weight of the brush cradle 300 when fitting 320 is connected with air inlet 102, fixing the orientation of the brush cradle 300 with respect to the vacuum cleaner 100. Fixing the orientation of the brush cradle 300 may facilitate insertion of a lint brush 200. In other exemplary embodiments, the fitting 320 may be coupled with the vacuum cleaner 100 such that the brush cradle 300 may rotate about a horizontal or a vertical axis. Rotatably attaching the fitting with respect to the connector may permit adjustment of the brush cradle 300 relative to the vacuum cleaner 100 to provide flexibility in the accessibility of the brush cradle 300. In exemplary embodiments, the fitting 320 may be at least partially flexible, such as to allow re-positioning of the brush cradle 300, or in instances in which supporting of the weight of the brush cradle 300 and/or a fixing the orientation of the brush cradle 300 is not required. In exemplary embodiments, one or more mechanical attachment devices may be provided in addition to fitting 320, that may be used to attach the brush cradle 300 to vacuum cleaner 100.

In particular embodiments, the fitting 320 may be adapted to provide electrical communication between the vacuum cleaner 100 and the brush cradle 300. For example, the fitting 320 may include one or more fitting electrical contacts (not shown) adapted to be engaged with one or more corresponding electrical contacts (not shown) on the vacuum cleaner 100 to provide electrical communication between the brush cradle 300 and the vacuum cleaner 100. The brush cradle 300 may also include an electrical control to provide electrical communication between the control and the vacuum cleaner 100 such as to operate one or more features of the vacuum cleaner 100. For example, the control may be a switch that activates or deactivates the vacuum source 104, or controls the level of suction produced by the vacuum source 104. One having ordinary skill in the art will appreciate the various types of switches that may be employed for this purpose, such as, for example, a microswitch, a position-sensitive switch or the like.

In one exemplary embodiment, the valve control 326 may be adapted to operate both the vacuum source 104 and the valve 324. For example, the valve control 326 may be manipulated to rotate valve 324 to an open position while simultaneously actuating the vacuum source 104 to cause air to flow through the chamber 312.

Figure 12:
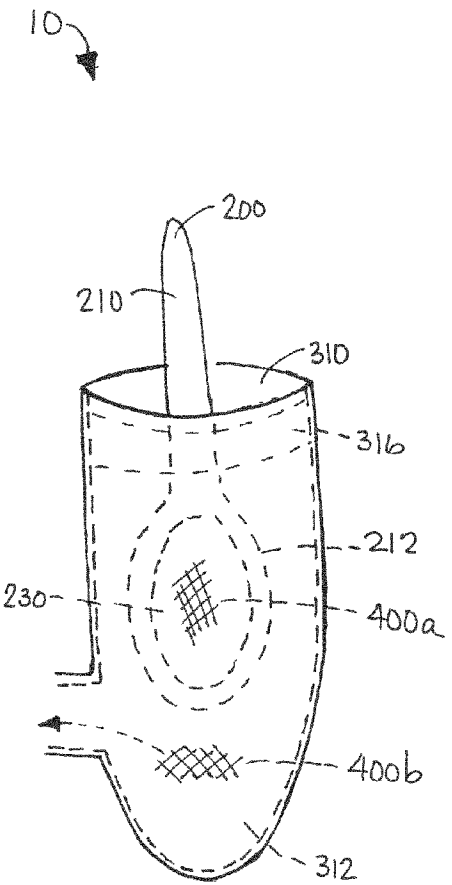
FIG. 12 is a front elevation view of the lint brush and a brush cradle of FIG. 11, shown with the brush in the cradle.
Figure 11:
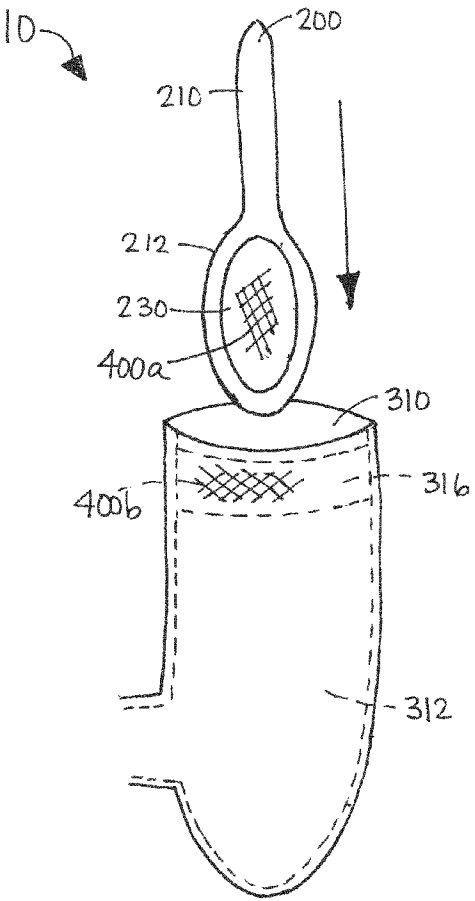
FIG. 11 is a front elevation view of a lint brush and a brush cradle in accordance with an exemplary embodiment.
Figure 13:
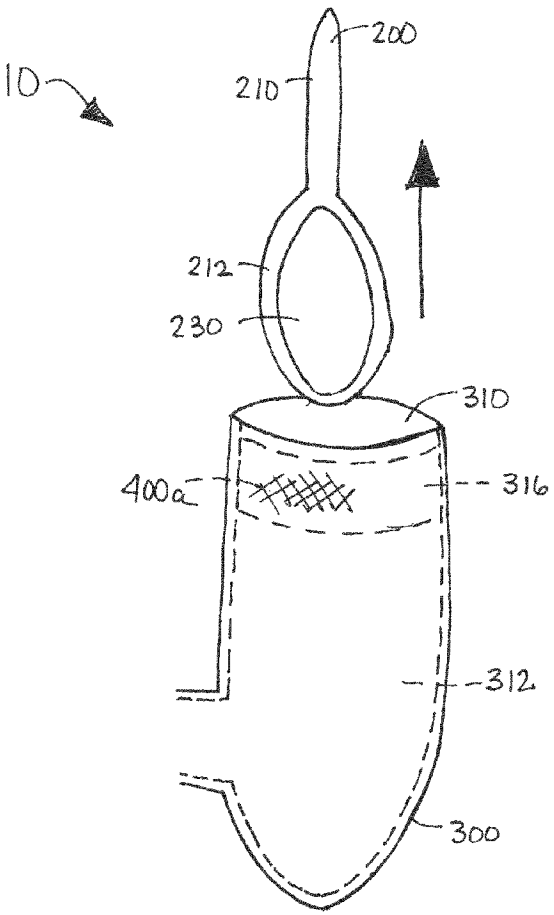
FIG. 13 is a front elevation view of the lint brush and brush cradle of FIG. 11, shown with the brush removed from the cradle.

Referring to FIGS. 11-13, an exemplary method of use is described. When exemplary lint brush 200 is used to remove fibrous substances and other debris from a surface to be cleaned, the fibrous substances 400*a* are collected on one or more of the brush materials 230 of lint brush 200. Referring to FIG. 11, when a user is finished cleaning the surface to be cleaned, the user may deposit the lint brush 200 in the brush cradle 300, to holster the brush and/or to clean the brush materials 230. The user inserts the brush portion 212 of the lint brush 200 into the chamber opening 310 of the brush cradle 300 in the direction of the arrow. As the lint brush 200 is inserted, brush materials 230 engage with opposing brush cleaning pads 316, rubbing against them as the lint brush 200 descends toward the chamber 312. In an exemplary embodiment, the brush cleaning pad 316 is a directional material, having a release direction oriented downward in the longitudinal direction 304, so that as the brush material 230 rubs downward on the opposing brush cleaning pad 316, fibrous substances 400*b* are released from the brush cleaning pad 316 and are swept into the chamber 312 (FIG. 12). During such downward movement, the cleaning pad 316 may not remove a substantial amount of fibrous material 400*a* from the brush material 230. If the vacuum source 104 is activated, and the chamber 312 is in fluid communication with the vacuum source 104, then the released fibrous substances 400*b* that are forced down into the chamber 312 may be entrained in the air flow from the chamber 312 toward the vacuum source 104 and removed to a filter, bag or other cleaning system.

Referring to FIG. 13, when the user removes the lint brush 200 from the brush cradle 300, the brush material 230 rubs upward against the brush cleaning pad 316, i.e., in the cleaning pad's pick-up direction. As the brush material 230 ascends, the brush cleaning pad 316 removes fibrous substances 400*a* from the brush material 230. Some of the removed fibrous substances fall into the chamber 312, and some of the removed fibrous substances 400*a* may be deposited on and cling to brush cleaning pad 316. Operating the valve may remove some or all of the fibrous substances 400*a* from the cleaning pads 316 and chamber 312. Also, the next time that the lint brush 200 is inserted into the brush cradle 300, the brush material 230 will again rub downward on the brush cleaning pad 316, removing the fibrous substances 400*a* from the brush cleaning pad and sweeping them into the chamber 312, as described above. It will be understood that the lint brush 200 may need to be inserted and removed from the chamber 312 multiple times as described herein to remove substantially all of the fibrous substances 400*a* from the brush material 230. In exemplary embodiments, the air flow generated between the opening 310 to the vacuum source 104 may help remove the fibrous substances 400*a*, 400*b* from the brush cleaning pad 316 and/or the brush material 230.

The embodiments described herein are not intended to limit the scope of the inventions recited in the appended claims. Furthermore, the claimed inventions may be practiced in any number of other ways, and, where suitable, in other contexts. For example, although many of the embodiments disclosed herein have been described with reference to vacuum cleaning devices, the principles herein are equally applicable to other types of devices. Indeed, various modifications of the embodiments of the present inventions, in addition to those described herein, will be apparent to those of ordinary skill in the art from the foregoing description and accompanying drawings. Such modifications are intended to fall within the scope of the following appended claims. Further, although some of the embodiments of the present invention have been described herein in the context of a particular implementation in a particular environment for a particular purpose, those of ordinary skill in the art will recognize that its usefulness is not limited thereto and that the embodiments of the present inventions can be beneficially implemented in any number of environments for any number of purposes. Accordingly, the claims set forth below should be construed broadly to encompass the full breath and spirit of the claimed inventions.

The invention claimed is:

1. A vacuum cleaner lint brush accessory system comprising:

a lint brush having a handle portion and a brush portion, the handle portion and brush portion being opposed in a longitudinal direction, the brush portion having a brush material disposed on at least one surface, wherein the brush material comprises a material adapted to remove fibrous substances from a surface to be cleaned; and a brush cradle having a chamber opening leading to a chamber, the chamber extending in the longitudinal direction and being adapted to longitudinally receive at least the brush portion of the lint brush, the chamber having at least one brush cleaning pad adapted to engage the brush material and remove the fibrous substances from the brush material, the chamber further comprising an air outlet spaced from the chamber opening, the air outlet being selectively connectable to a vacuum passage of a vacuum cleaner.

2. The vacuum cleaner lint brush accessory system of claim 1, wherein the brush material comprises directional brush piles.

3. The vacuum cleaner lint brush accessory system of claim 2, wherein the directional brush piles are oriented transversely to the longitudinal direction.

4. The vacuum cleaner lint brush accessory system of claim 1, wherein the at least one brush cleaning pad comprises directional pad piles.

5. The vacuum cleaner lint brush accessory system of claim 4, wherein the directional pad piles are oriented from about 0 degrees to about 45 degrees from the longitudinal direction.

6. The vacuum cleaner lint brush accessory system of claim 4, wherein the directional pad piles are oriented from about 45 degrees to about 90 degrees from the longitudinal direction.

7. The vacuum cleaner lint brush accessory system of claim 1, wherein the at least one brush cleaning pad is generally adjacent, but spaced from the chamber opening.

8. The vacuum cleaner lint brush accessory system of claim 1, wherein the brush portion has opposed front and back surfaces, and the brush material comprises a first brush portion disposed on the front surface and a second brush portion disposed on the back surface.

9. The vacuum cleaner lint brush accessory system of claim 8, wherein the first brush portion comprises first directional brush piles having a pick-up direction oriented in a first transverse direction relative to the longitudinal direction, and the second brush portion comprises second directional brush piles having a pick-up direction oriented in the first transverse direction relative to the longitudinal direction.

10. The vacuum cleaner lint brush accessory system claim 8, wherein the at least one brush cleaning pad comprises a first brush cleaning pad disposed in a facing arrangement with the front surface of the lint brush when the lint brush is received in the chamber, and a second brush cleaning pad disposed in facing arrangement with the back surface of the lint brush when the lint brush is received in the chamber.

11. The vacuum cleaner lint brush accessory system claim 8, wherein the at least one brush cleaning pad comprises a first brush cleaning pad comprising third directional piles disposed in a facing arrangement with the front surface of the lint brush when the lint brush is received in the chamber, and a second brush cleaning pad comprising fourth directional piles disposed in facing arrangement with the back surface of the lint brush when the lint brush is received in the chamber.

12. The vacuum cleaner lint brush accessory system of claim 11, wherein the third directional piles and fourth directional piles have respective pick-up directions oriented longitudinally from the handle portion to the brush portion to remove from the fibrous substances when the brush is removed from the chamber.

13. The vacuum cleaner lint brush accessory system of claim 1, further comprising a valve in the air outlet, the valve being selectively moveable between a first position in which it connects the chamber to the vacuum passage, and a second position in which it disconnects the chamber from the vacuum passage.

14. The vacuum cleaner lint brush accessory system of claim 13, further comprising a manual valve control adapted to move the valve between the first position and the second position.

15. The vacuum cleaner lint brush accessory system of claim 1, further comprising a sleeve disposed within the chamber intermediate the chamber opening and the air outlet, the sleeve being adapted to suspend the lint brush in the chamber such that the lint brush does not block the air outlet, the sleeve having one or more holes adapted to permit air to flow from the chamber opening to the air outlet.

16. The vacuum cleaner lint brush accessory system of claim 15, wherein the sleeve is spaced from an end of the chamber opposite from the chamber opening to thereby define a fiber trap between the sleeve and the end of the chamber, and the air outlet is adjacent the fiber trap.

17. The vacuum cleaner lint brush accessory system of claim 1, wherein the lint brush and chamber opening are sized to permit air to flow from the chamber opening to the air outlet when the lint brush is fully inserted in the chamber.

18. The vacuum cleaner lint brush accessory system of claim 1, wherein:

the brush has opposed front and back surfaces and a side surface joining the front and back surfaces;

the brush material is disposed on at least one of the front and back surfaces; and at least one friction material is disposed on the side surface.

19. The vacuum cleaner lint brush accessory system of claim 18, wherein the friction material comprises a strip of friction material that extends along the side surface.

20. The vacuum cleaner lint brush accessory system of claim 19, wherein the friction material comprises one or more protrusions extending from the side surface.

* * * * *